US005685253A

United States Patent [19]

Alexander, Jr.

[11] Patent Number: 5,685,253

[45] Date of Patent: Nov. 11, 1997

[54] REDUCED DRAG STABLE VEE BOTTOM PLANING BOAT

[75] Inventor: Charles F. Alexander, Jr., Austin, Tex.

[73] Assignee: Brunswick Corporation, Lake Forest, Ill.

[21] Appl. No.: 492,494

[22] Filed: Jun. 20, 1995

Related U.S. Application Data

[63] Continuation of Ser. No. 149,327, Nov. 9, 1993, abandoned, which is a continuation-in-part of Ser. No. 83,703, Jun. 25, 1993, abandoned, which is a continuation-in-part of Ser. No. 889,495, May 27, 1992, Pat. No. 5,230,644, and a continuation-in-part of Ser. No. 889,530, May 27, 1992, Pat. No. 5,249,995.

[51] Int. Cl.[6] ..... B63B 1/32

[52] U.S. Cl. ..... 114/291; 114/271

[58] Field of Search ..... 440/1, 61, 53, 440/66, 69, 68; 114/271, 291, 274, 290, 284, 289, 285, 238, 56, 61, 280; D12/300, 310–314

[56] References Cited

U.S. PATENT DOCUMENTS

| | | | |
|---|---|---|---|
| 3,091,206 | 5/1963 | Cale | 114/291 |
| 3,203,389 | 8/1965 | Cale | 114/289 |
| 3,216,389 | 11/1965 | Thorsen | 114/56 |
| 3,457,064 | 7/1969 | Glass | 114/289 |
| 3,463,109 | 8/1969 | Weiler | 114/286 |
| 3,468,282 | 9/1969 | Wintercorn | 440/1 |
| 3,469,557 | 9/1969 | Wollard | 440/66 |
| 3,763,810 | 10/1973 | Payne | 114/285 |
| 4,027,613 | 6/1977 | Wollard | 114/291 |
| 4,231,314 | 11/1980 | Peters | 114/291 |
| 4,619,215 | 10/1986 | Wood et al. | 114/291 |
| 4,689,026 | 8/1987 | Small | 440/69 |
| 4,708,085 | 11/1987 | Blee | 114/288 |
| 4,748,929 | 6/1988 | Payne | 114/288 |
| 4,903,626 | 2/1990 | Haines | 114/56 |
| 5,111,767 | 5/1992 | Haines | 114/288 |

OTHER PUBLICATIONS

"Hydrodynamic Design of Planing Hulls", D. Savitsky, Marine Technology, Oct., 1964, pp. 71–95.

"Reduction of Planing Boat Resistance By Deflectin of the Whisker Spray, E.P. Clement, Dept. of the Navy, Research and Dev." Report 1929, Nov., 1964, pp. 1–23.

"Effects of Step Design on the Performance of Planing Motorboats", E.P. Clement et al, The Society of Naval Architects and Marine Engineers, Fourth Biennial Power Boat Symposium, 1991, pp. B1–B25.

"Optimized Designs For Stepped Planing Monohulls and Catamarans", E.P. Clement et al, High Performance Marine Vehicles '92 Conf, pp. PC35–PC44.

*Primary Examiner*—Edwin L. Swinehart

*Attorney, Agent, or Firm*—Andrus, Sceales, Starke & Sawall

[57] ABSTRACT

In a Vee bottom planing boat running chines dry at top speed, running trim angle is increased by reducing wetted planing surface area by removing wetted planing surface at areas of least dynamic pressure and by shifting a portion of the trailing edge of the wetted planing surface forwardly, in combination, until running trim angle is slightly less than porpoising trim angle and such that the boat can be made to porpoise by trimming the drive when the boat is running at 70% to 100% of top speed.

13 Claims, 6 Drawing Sheets

FIG. 11
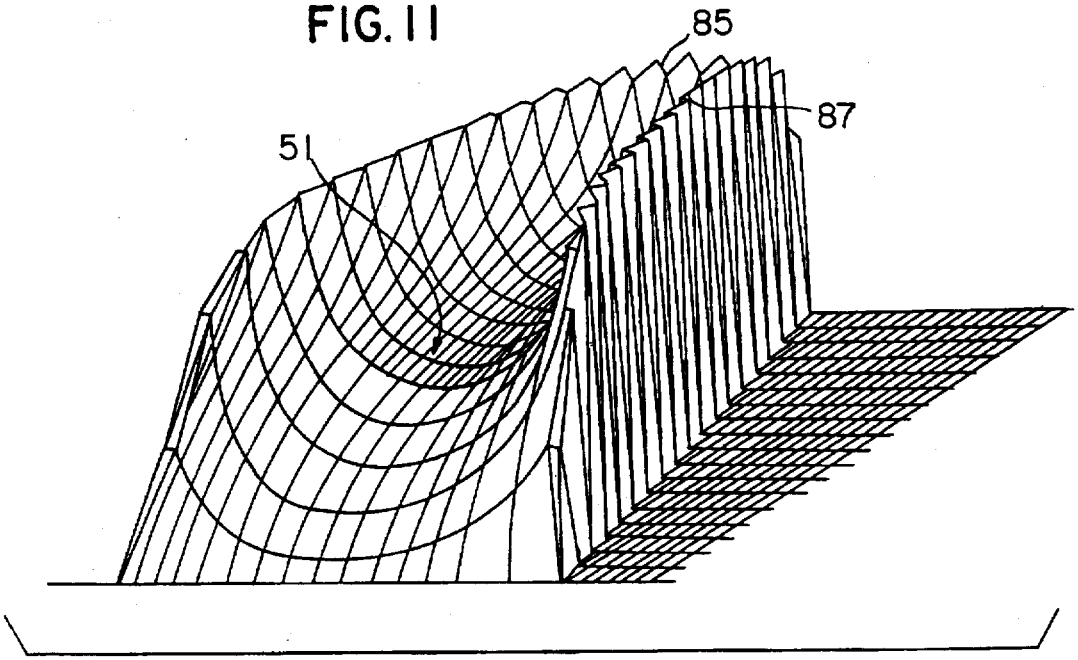
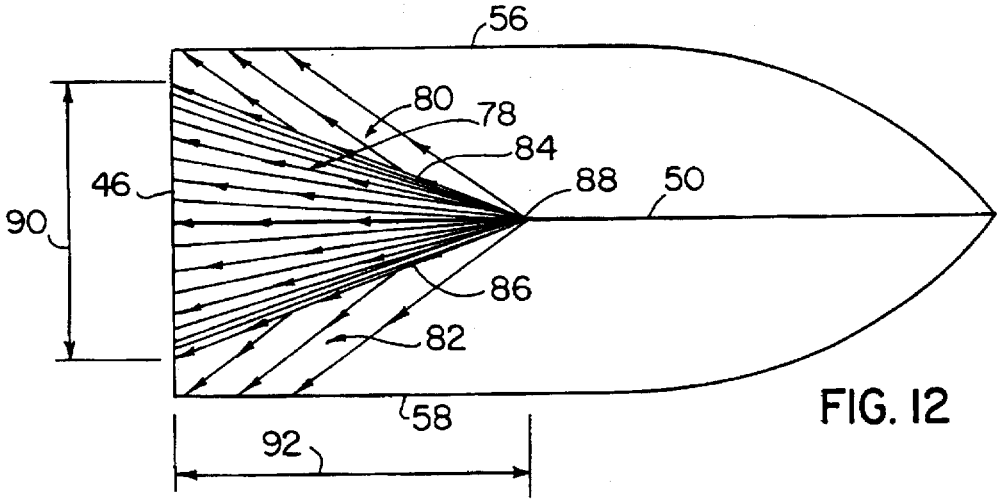
FIG. 12
FIG. 13
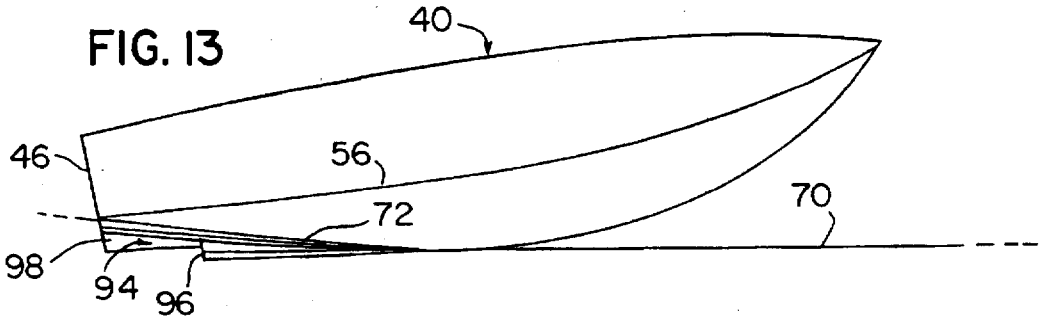

REDUCED DRAG STABLE VEE BOTTOM PLANING BOAT

CROSS REFERENCE TO RELATED APPLICATIONS

This is a continuation of application Ser. No. 08/149,327, filed Nov. 9, 1993, now abandoned, which is a continuation-in-part of U.S. application Ser. No. 08/083,703, filed Jun. 25, 1993, which is a continuation-in-part of U.S. application Ser. No. 07/889,495, filed May 27, 1992, U.S. Pat. No. 5,230,644, and a continuation in part of U.S. application Ser. No. 07/889,530, filed May 27, 1992, U.S. Pat. No. 5,249,995, incorporated herein by reference.

BACKGROUND AND SUMMARY

The invention relates to Vee bottom high speed planing boats and marine drives.

In Vee bottom planing boats, the desired arrangement of accommodations within the boat typically moves the center of gravity too far forward to minimize water drag at higher speeds. Because of this center of gravity position, such boats run with too much wetted surface area, which in turn creates extra drag.

Power trim systems, which are popular on stern drives and larger outboard motors, provide a partial solution to the noted problem. Power trim tilts the propeller out and up, producing a downward force at the stern, to in turn lift the bow. This reduces the boat drag by reducing the wetted surface area by reducing wetted keel length, but some of the possible gain is lost because the downward force at the stern increases the downward force of the boat on the water.

Pleasure boats that run above 45 or 55 miles per hour have another significant source of extra drag which increases rapidly with increasing speed. This extra drag comes from the gear housing and propeller hub moving through the water. The noted parent application provides a reduced drag surfacing drive operating the gear case torpedo above the water surface at high speed. Only the skeg below the torpedo is in the water. Two counter-rotating coaxial propellers operate with their hubs above the water and their blades dipping into the water to provide thrust. This minimizes the drag of the propulsion system. However, such surfacing propellers have reduced ability to provide a downward force at the stern to lift the bow to minimize boat drag. This is because when the drive is trimmed out to lift the bow, the propellers come further out of the water, thereby reducing the downward force at the stern to lift the bow.

In the present invention, boat drag is minimized at top speed by increasing running trim angle to be close to porpoising trim angle. Running trim angle is the angle between the keel and the undisturbed water surface. In a Vee bottom planing boat running chines dry at top speed, there is minimum drag when the running trim angle is as close as possible to porpoising trim angle. A boat is running chines dry when the solid water on which the boat is planing leaves the trailing edge of the planing surface inside of the chines. The solid water boundaries are the two spray root lines extending rearwardly and outwardly from the point at which the keel intersects the undisturbed water surface. The spray is on each outward side of the spray root lines. Porpoising is an unstable oscillation of the boat in pitch, i.e. the bow bounces up and down. Porpoising occurs when the running trim angle exceeds a critical value, namely porpoising trim angle, which is determined by the boat speed, weight, and deadrise angle.

The higher the boat speed, the more difficult it is to make the boat porpoise. This is because the higher the boat speed the smaller the running trim angle. With a surfacing drive, the boat runs with a smaller trim angle than a submerged drive. In a surfacing drive, it is more difficult to increase running trim angle towards porpoising trim angle because when the drive is trimmed out, the propellers are lifted further out of the water and hence have less ability to provide downward force at the stern to lift the bow. When a submerged drive is trimmed out, the propellers remain submerged or have a greater percentage of blade area submerged, and hence provide a greater downward force at the stern, and increased bow lift.

As boat speed is reduced below top speed, the boat transom will sink deeper in the water as the running trim angle increases at an approximately constant wetted keel length. This is because the center of water pressure has to stay near the center of gravity for boat balance, and since the center of gravity position isn't changing, the center of pressure position likewise won't change, at least not significantly. Hence, the stern sinks deeper in the water as the boat slows down, increasing the running trim angle, and maintaining the noted approximately constant wetted keel length. The sinking of the stern deeper in the water increases the water pressure surface area in contact with solid water which in combination with the increased angle of attack provides the requisite lift to support the boat weight with less dynamic pressure as boat speed is reduced. It is typical of boats that run chines dry at top speed that the boat cannot be made to porpoise, i.e. running trim angle cannot be made to increase to porpoising trim angle, until boat speed drops to about 60% or less of top speed.

BRIEF DESCRIPTION OF THE DRAWINGS

FIG. 11 is a diagram illustrating water pressure along the boat bottom of FIG. 10 projected onto a plane through the keel.

FIG. 12 is a view from below of the boat of FIG. 4 and shows the water flow path.

FIG. 13 is a side elevation view of a Vee bottom planing boat with a notch and shows the wetted planing surface.

DETAILED DESCRIPTION

Figure 1:
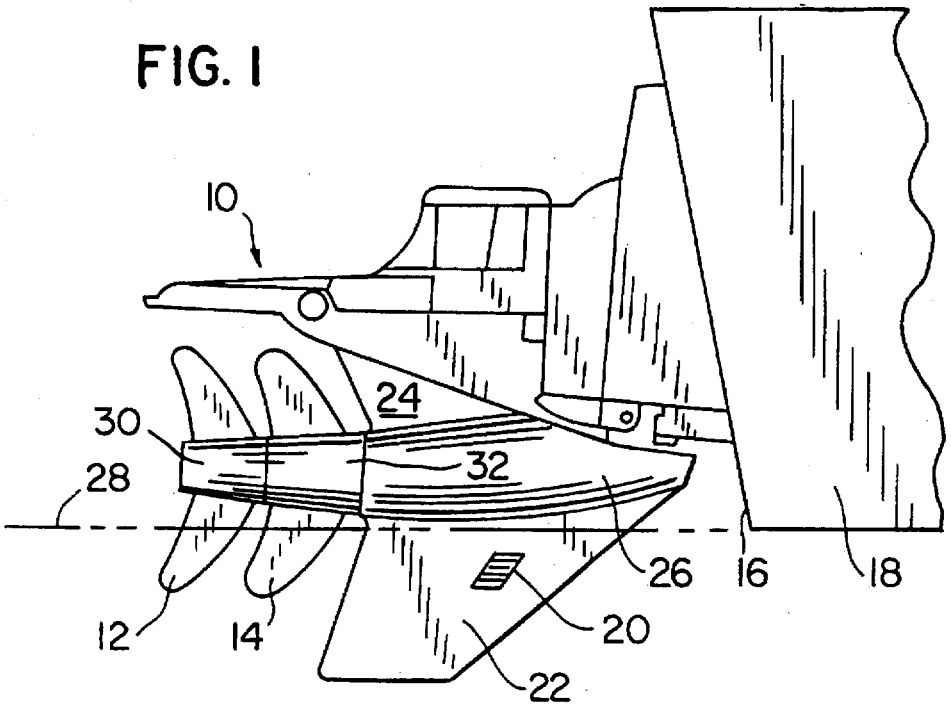
FIG. 1 is side elevation view of a marine drive in accordance with the noted parent application.

FIG. 1 shows a marine drive 10 having two counter-rotating surface operating propellers 12 and 14. The drive is mounted to the transom 16 of a boat 18 in the usual manner for a stern drive. Cooling water for the engine is supplied through water intake 20 in skeg 22 of housing 24. Torpedo or gear box 26 is raised such that it is entirely above the water surface during high speed operation with the boat on plane. Torpedo 26 is entirely above the plane 28 of the bottom of boat 18 when the shafts for propellers 12 and 14 are parallel to plane 28. The bottom of torpedo 26 is at or above plane 28 during high speed operation. Respective propellers 12 and 14 include propeller hubs 30 and 32. The bottom of each propeller hub 30 and 32 is at or above plane 28, and each propeller hub is preferably entirely above the water surface, when the propeller shafts are parallel to plane 28.

Housing 24 has the noted skeg 22 extending downwardly below torpedo 26. During normal running operation with the boat on plane, the water line is above water intake 20. The water line is at or below the bottom of torpedo 26. Each propeller has a plurality of blades extending radially from the respective hub and defining a propeller diameter across the circumference defined by the outer tips of the blades during rotation. In the preferred embodiment, one-third to one-fifth of the propeller diameter is below plane 28. In one implementation, the dimension of propeller diameter below plane 28 is about 3 inches, and rotational axis centerline of the propellers is about 5 inches above plane 28 when the propeller shafts are parallel to plane 28.

As above noted, drive 10 is trimmable in and out. When the drive is trimmed in, FIG. 2, the aft end of torpedo 26 moves downwardly. When the drive is trimmed out, FIG. 3, the aft end of torpedo 26 moves upwardly. The drive has a given trimmed-in condition, FIG. 2, wherein torpedo 26 extends at an upward angle from the aft end thereof, and the bottom of propeller hubs 30 and 32 define a horizontal line at or above plane 28. This reduces drag, including in the trimmed-in condition, by keeping both hubs and the torpedo above the water line.

Figure 6:
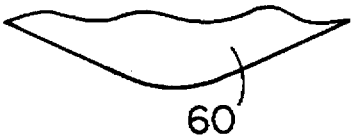
FIG. 6 is a view of a portion of FIG. 5 and shows a further embodiment.
Figure 7:
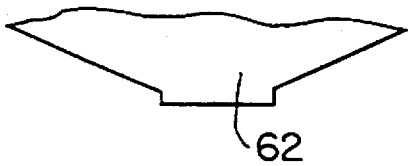
FIG. 7 is a view of a portion of FIG. 5 and shows a further embodiment.
Figure 8:
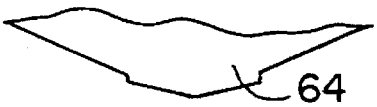
FIG. 8 is a view of a portion of FIG. 5 and shows a further embodiment.
Figure 9:
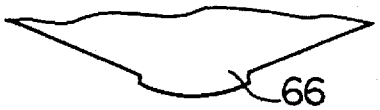
FIG. 9 is a view of a portion of FIG. 5 and shows a further embodiment.
Figure 4:
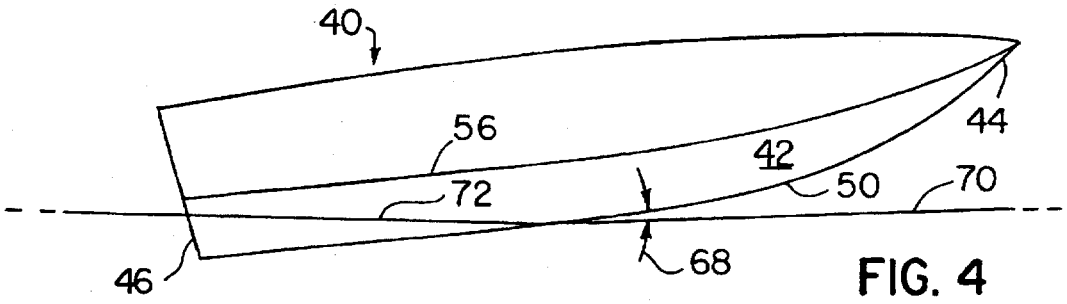
FIG. 4 is a side elevation view of a Vee bottom planing boat, illustrating running trim angle.
Figure 5:
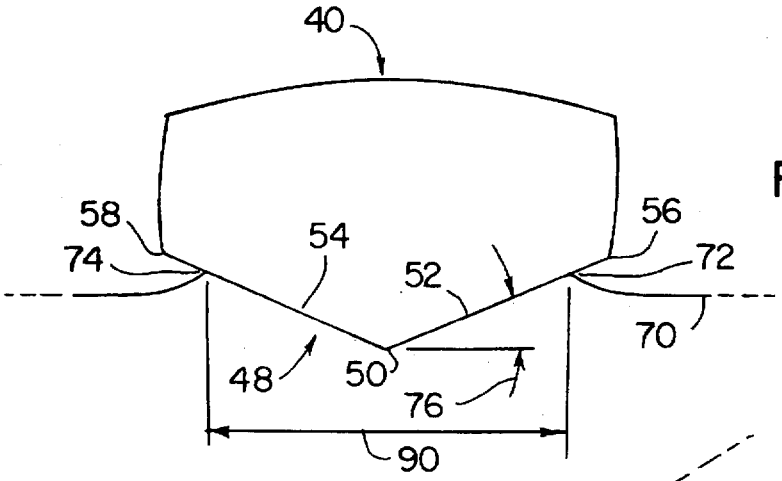
FIG. 5 is a rear elevation view of the boat of FIG. 4.

FIGS. 4 and 5 show a Vee bottom planing boat 40 having a boat hull 4 2 extending from the bow 44 to an aft end 46 and having a generally V-shaped lower surface 48, FIG. 5, with a longitudinally extending keel 50 and upwardly slanted surfaces 52 and 54 extending oppositely therefrom to chines 56 and 58. The keel may have a V-shape with a pointed apex as shown in FIG. 5, or a curved apex as shown at 60 in FIG. 6, or may be provided by a lower pad having a flat lower surface as shown at 62 in FIG. 7, or a V-shaped lower surface 64 as shown in FIG. 8, or a curved lower surface 66 as shown in FIG. 9, or various other alternatives. FIG. 4 shows the boat operating at a running trim angle 68, which is the angle between the keel and the undisturbed water line 70. FIG. 4 also shows the boat running chines dry, meaning that chines 56 and 58, including at aft end 46, are above the respective solid water lines 72 and 74, FIG. 5, which rise above the undisturbed water line 70. FIG. 5 shows the deadrise angle of the V at 76.

Figure 10:
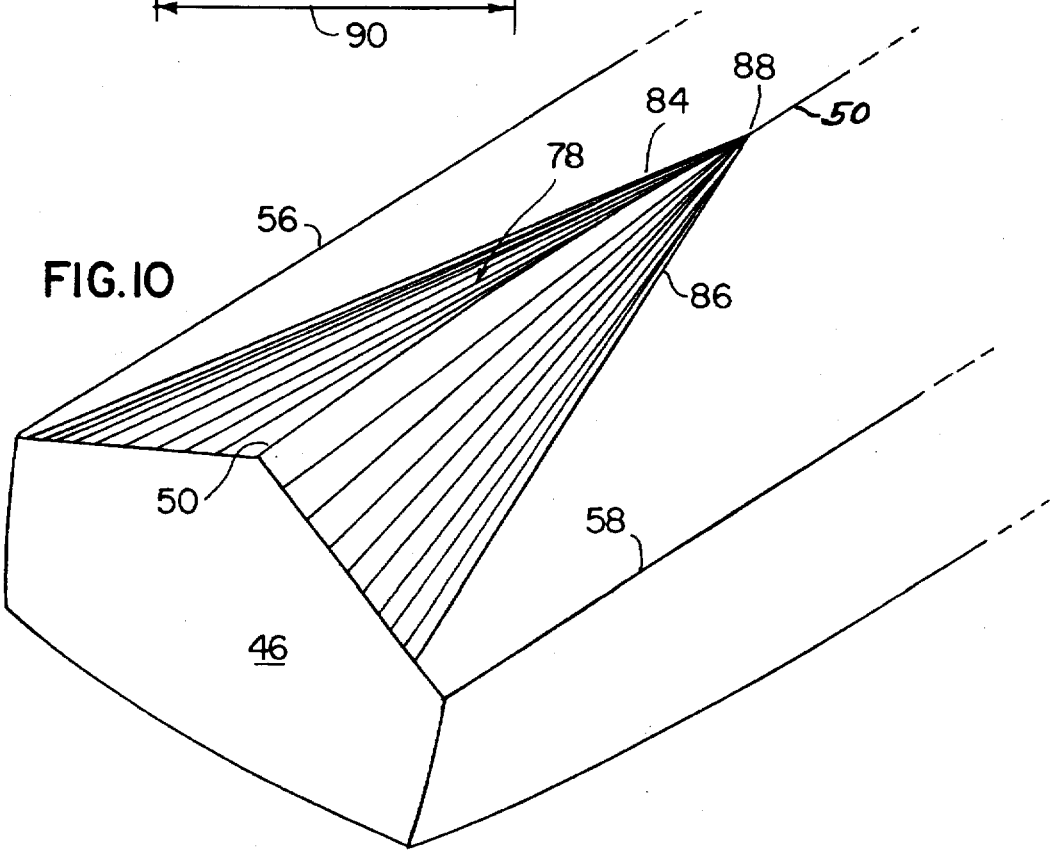
FIG. 10 is an isometric view from below of the boat of FIG. 4 and shows the wetted planing surface.

The portion of the boat hull contacted by solid water is the pressure area known as the wetted planing surface 78, FIGS. 10 and 12. It is the water pressure on this area that carries most of the weight of a high speed planing boat. Immediately outside of the pressure area are the spray areas 80 and 82, FIG. 12. The dividing lines between the spray areas and the pressure area are called spray root lines 84 and 86, so called because the spray originates on these lines where the solid water meets the boat bottom. The spray area provides some drag but no useful lift. The direction of solid water flow is shown by the arrows in FIG. 12 along wetted planing surface 78. The direction of spray water flow is shown by the arrows along spray areas 80, 82.

A boat is said to be planing "chines dry" if the spray root lines 84 and 86 do not cross chines 56 and 58, but rather pass across the aft end of the planing surface. A boat is said to be planing "chines wet" if the spray root lines 84 and 86 cross chines 56 and 58 ahead of the aft end of the planing surface. Wetted planing surface 78 has a forward leading end 88 and is defined by the noted spray root lines 84 and 86 and the trailing edge of the planing surface. The spray root lines 84 and 86 define the boundary between water spray laterally outward of the spray root line, and solid water laterally inward of the spray root line. The wetted beam 90, FIG. 12, is the distance between spray root lines 84 and 86 at the aft end of the planing surface. Wetted keel length is shown at 92. Dynamic water pressure on the wetted planing surface is illustrated in the pressure diagram in FIG. 11 which shows the dynamic pressure projected onto a horizontal plane that passes through the keel. The pressure is highest at pressure peaks 85 and 87 near the spray root lines 84 and 86, and lower at pressure trough 51 near keel 50. The pressure falls off to zero at the trailing edge of the planing surface.

Porpoising is an unstable oscillation of the boat in pitch, i.e. the bow bounces up and down. Porpoising occurs when running trim angle 68, FIG. 4, exceeds a critical value that is determined by boat speed, weight and deadrise angle 76. Minimum boat drag, however, occurs on boats planing chines dry at top speed at a running trim angle where porpoising begins. Such running trim angle produces the minimum wetted keel length and minimum wetted planing surface. Since it is desirable to have minimum boat drag at top speed and stable boat operation, the optimum running trim angle is that which is just short of producing porpoising or produces very mild porpoising.

For typical Vee bottom planing boats running at top speeds greater than about 45 or 55 miles per hour, it is not practical to move the center of gravity far enough aft to operate at an optimum running trim angle close to the porpoising trim angle. In the present invention, running trim angle is increased by removing wetted planing surface at areas of least dynamic pressure by shifting a portion of the trailing edge of the wetted planing surface forwardly to a fore-aft location such that the boat can be made to porpoise by trimming the drive, including surfacing drives, when the boat is running at 70% to 100% of top speed. This range provides the optimum combination of removal of wetted planing surface area and forward shifting of a portion of the trailing edge of the wetted planing surface to optimally increase running trim angle as close as possible to porpoising trim angle. If the boat cannot be made to porpoise by trimming the drive, until a lower percentage of top speed, then the boat is running at less than optimum running trim angle for reduced drag at top speed. For a submerged drive, with at least one propeller running mostly below the surface of the water, the lower limit of speed reduction before the boat can be made to porpoise need not be as low as for a surfacing drive. For a submerged drive, with its greater ability to lift the bow of the boat and cause it to porpoise, the noted optimum combination is provided when the boat can be made to porpoise when running at 80% to 100% of top speed. A surfacing drive is a drive with at least one propeller running with at least about 25% of propeller diameter above the plane of the boat bottom. A submerged drive is a drive with at least one propeller running with less than about 25% of propeller diameter above the plane of the boat bottom.

Figure 14:
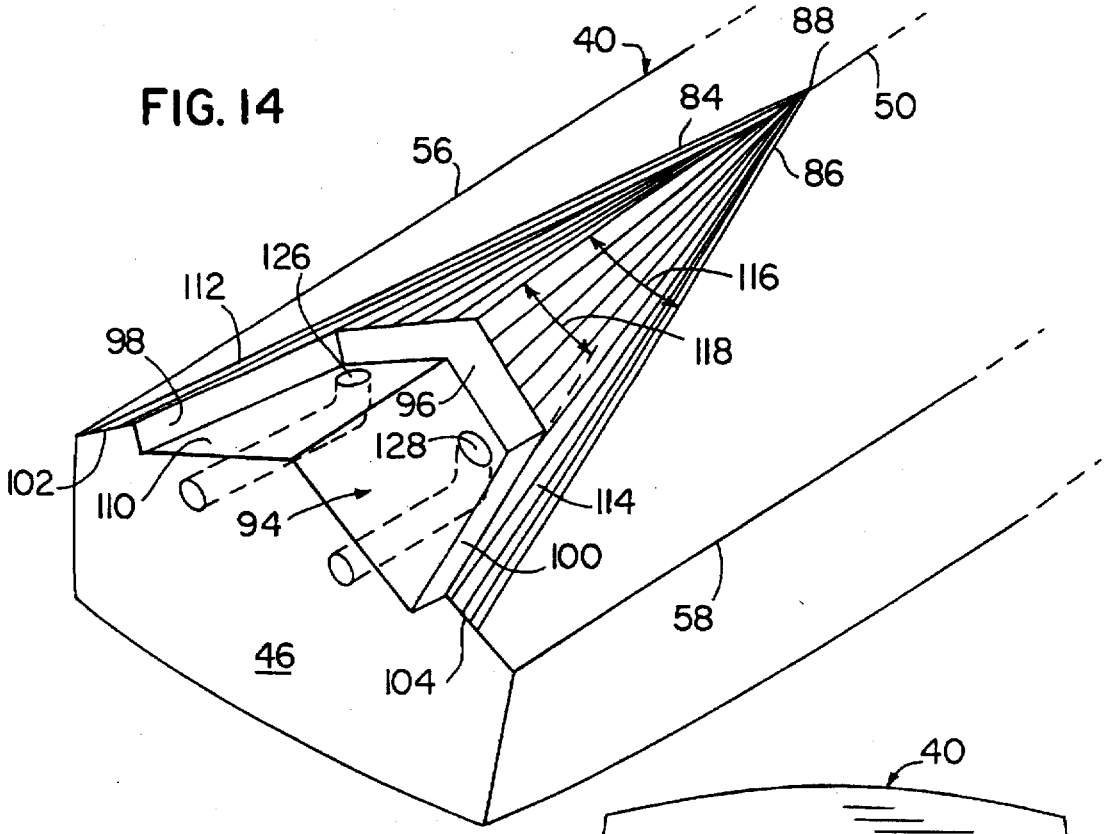
FIG. 14 is an isometric view from below of the boat of FIG. 13.
Figure 15:
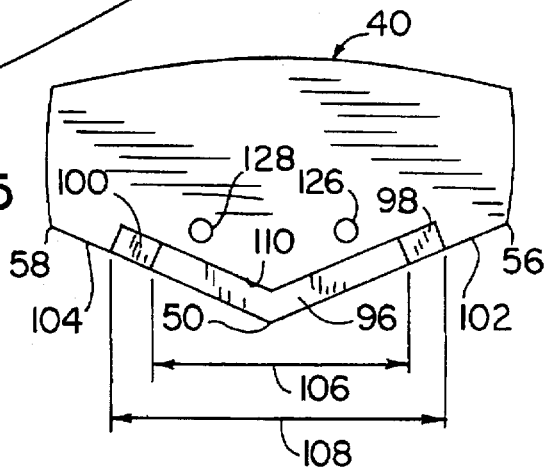
FIG. 15 is a rear elevation view of the boat of FIG. 13.
Figure 16:
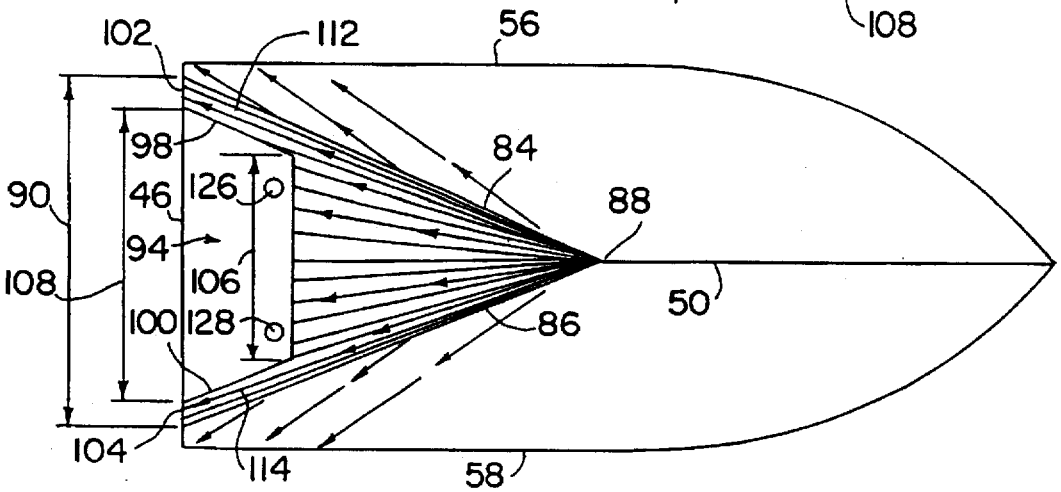
FIG. 16 is a view from below of the boat of FIG. 13 and shows the water flow path.

FIGS. 13, 14 and 16 show a Vee bottom planing boat running chines dry at top speed at increased running trim angle caused by removing wetted planing surface at areas of least dynamic pressure by shifting a portion of the trailing edge of the wetted planing surface forwardly, in combination. FIGS. 13–16 use like reference numerals from above where appropriate to facilitate understanding. A notch 94 in the lower surface of the hull has a forward end forming a step 96 in the lower surface, and sides 98 and 100, FIGS. 14 and 16, extending rearwardly therefrom. The trailing edge of the wetted planing surface has a forward portion at the forward end of the notch at step 96, and rearward portions 102 and 104 laterally outward of the notch. Notch sides 98 and 100 extend rearwardly and outwardly from step 96 such that the notch spreads and tapers outwardly from front to rear, i.e. fore to aft, to provide increasing notch width from step 96 to the rearward portions 102 and 104 of the trailing edge of the wetted planing surface. The width 106, FIG. 16, of notch 94 at step 96 is less than the width 108 of the notch at aft end 46 which in turn is less than planing beam 90.

Notch sides 98 and 100 are tapered outwardly such that at top speed the notch sides are uncontacted by solid water breaking off step 96, to reduce drag. If the sides of the notch extended longitudinally parallel to keel 50, then solid water breaking off step 96 would continue along the angle shown by the arrows, and some of such solid water flow would strike the notch sides, thus increasing drag.

The boat hull has a raised undersurface 110, FIGS. 14 and 15, in the notch and extending rearwardly from step 96. The notch has a depth such that water breaking off step 96 does not contact raised undersurface 110 at top speed, including at aft end 46. This further reduces drag. However, the notch depth is such that at speeds less than top speed while the boat is getting up on plane, water breaking off step 96 does contact raised undersurface 110 and provides lift to aid planing.

The lower surface of the hull has aft outer wetted planing surfaces 112 and 114, FIGS. 14 and 16, covered by solid water inside the spray root lines, and extending fore to aft adjacent notch sides 98 and 100 and outward of notch 94. At top speed, the lateral width of each of these solid water contact areas 112 and 114 between the notch and the spray root lines adjacent the aft end of the notch at trailing edge portions 102 and 104 is less than or equal to the lateral width of such areas 112 and 114 adjacent the forward end of the notch at step 96. Spray root lines 84 and 86 extend rearwardly and outwardly from keel 50 at an angle 116 in the plane of the boat bottom relative to the keel. Notch sides 98 and 100 extend rearwardly and outwardly from step 96 along an angle 118 in the plane of the boat bottom relative to keel 50. Angle 118 is greater than or equal to angle 116. Spray root lines 84 and 86 at top speed cross rearmost trailing edge portions 102 and 104 of the wetted planing surface, but do not cross step 96 nor notch sides 98 and 100.

Figure 17:
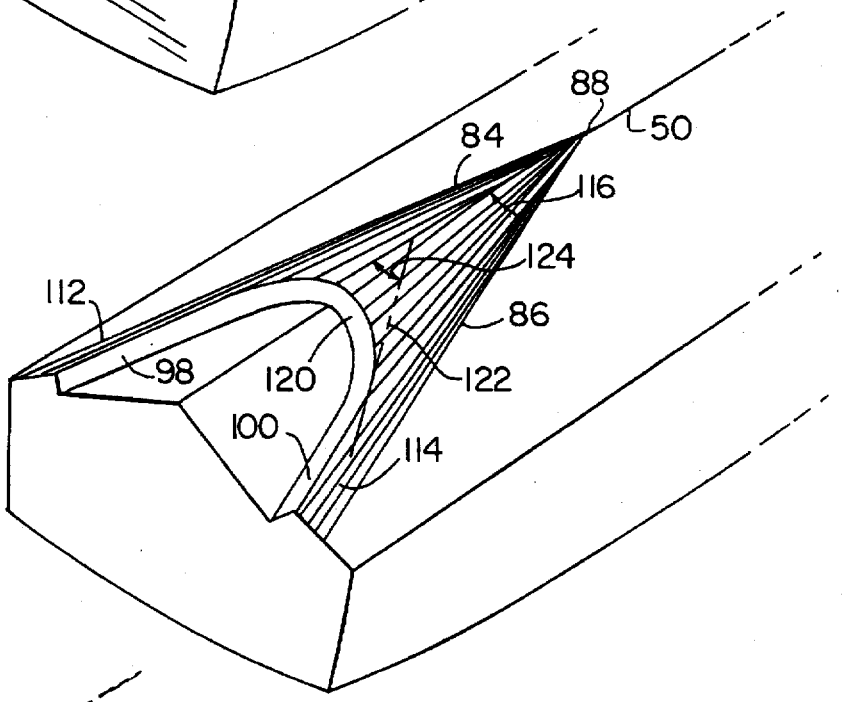
FIG. 17 is a view like FIG. 14 and shows a further embodiment.

In a further embodiment, the forward end of the notch is rounded or curved at 120, FIG. 17, and may be extended further forwardly to remove additional portions of the wetted planing surface at areas of least pressure. Wetted planing surface area is reduced by shifting a portion of the trailing edge of the wetted planing surface forwardly along the noted tapered angle relative to the keel such that the shifted portion of the trailing edge tapers laterally inwardly toward the keel as such shifted trailing edge of the wetted planing surface extends forwardly. Spray root lines 84 and 86 extend at the noted angle 116 relative to the keel. The forwardly shifted trailing edge of the wetted planing surface is tapered at sides 98 and 100 along an angle relative to the keel which is greater than or equal to the angle of the spray root lines relative to the keel. A tangent 122, FIG. 17, drawn to the curve of the notch at any point in the plane of the boat bottom will make an angle 124 relative to the keel which is greater than angle 116. The distance between spray root lines 84 and 86 at top speed and the sides 98 and 100 of the curved notch decreases fore to aft.

The solid water inside the spray root lines contacting the aft outer planing surfaces 112 and 114, FIGS. 16 and 17, reduces the tendency of the boat to chine walk by providing increased lateral stability. A boat "chine walks" when it rocks laterally from side to side. A notch which is too wide, or a planing beam which is too narrow, would tend to permit chine walking at high speed.

In some implementations, it may be desirable to provide vents 126 and 128, FIG. 14, communicating ambient atmosphere to the notch, to relieve any vacuum created aft of step 96 while the boat is getting up on plane. This in turn aids planing. The vents are provided by a pair of tubes extending upwardly and then rearwardly to aft end 46.

Figure 18:
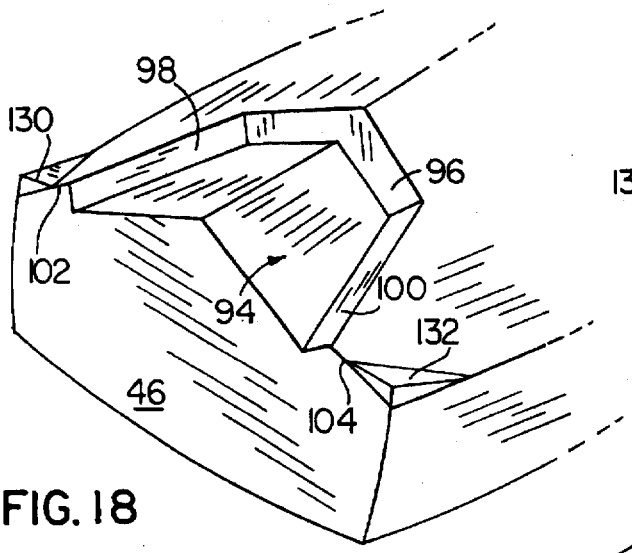
FIG. 18 is a view like a portion of FIG. 14 and shows a further embodiment.

In a further embodiment, a pair of downwardly protruding wedges 130 and 132, FIG. 18, are provided on the lower surface of the boat hull proximate the rearmost trailing edge portions 102 and 104. The wedges are totally or partially laterally outward of the spray root lines at top speed, such that they are not effective or are only partially effective at top speed. As the boat slows down and sinks deeper in the water, the planing beam increases, and wedges 130 and 132 become effective as they contact more solid water flow, to provide added stern lift and help prevent porpoising.

Figure 19:
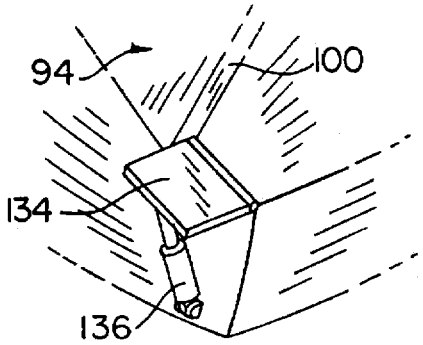
FIG. 19 is a view like a portion of FIG. 14 and shows a further embodiment.

In a further embodiment, trim tabs such as 134, FIG. 19, are provided proximate the rearmost trailing edge portions 102 and 104 on laterally opposite sides of the notch and are crossed by the spray root lines at top speed. The trim tabs may be adjustable up and down, e.g. by a hydraulic cylinder like 136, to provide additional stern lift as desired to prevent porpoising at any speed. Also, at any speed trim tabs can be adjusted oppositely to keep the boat level laterally in a crosswind or to correct for lateral shifting of people in the boat.

Figure 20:
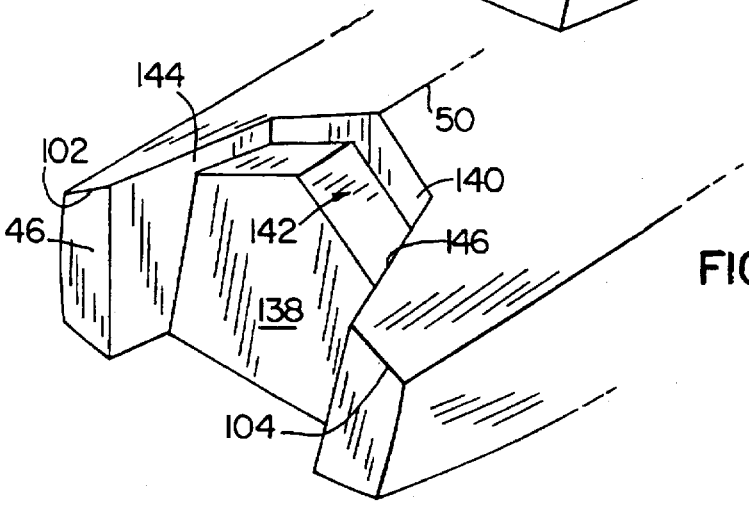
FIG. 20 is a view like a portion of FIG. 14 and shows a further embodiment.

In the above embodiments, the transom of the boat is at aft end 46 and intersects rearward trailing edge portions 102 and 104. In a further embodiment as shown in FIG. 20, the transom 138 is forward of the aft end of the boat and trailing edge portions 102 and 104. Transom 138 is aft of step 140 formed at the forward end of notch 142. The notch has sides 144 and 146 extending rearwardly from step 140 to rearward trailing edge portions 102 and 104. In a further embodiment, the transom may be shifted further forwardly and be at the step formed at the forward end of the notch. The propulsion drive unit, e.g. a stern drive, an outboard drive, an L-drive, or other trimmable drive, is mounted to the transom.

Figure 2:
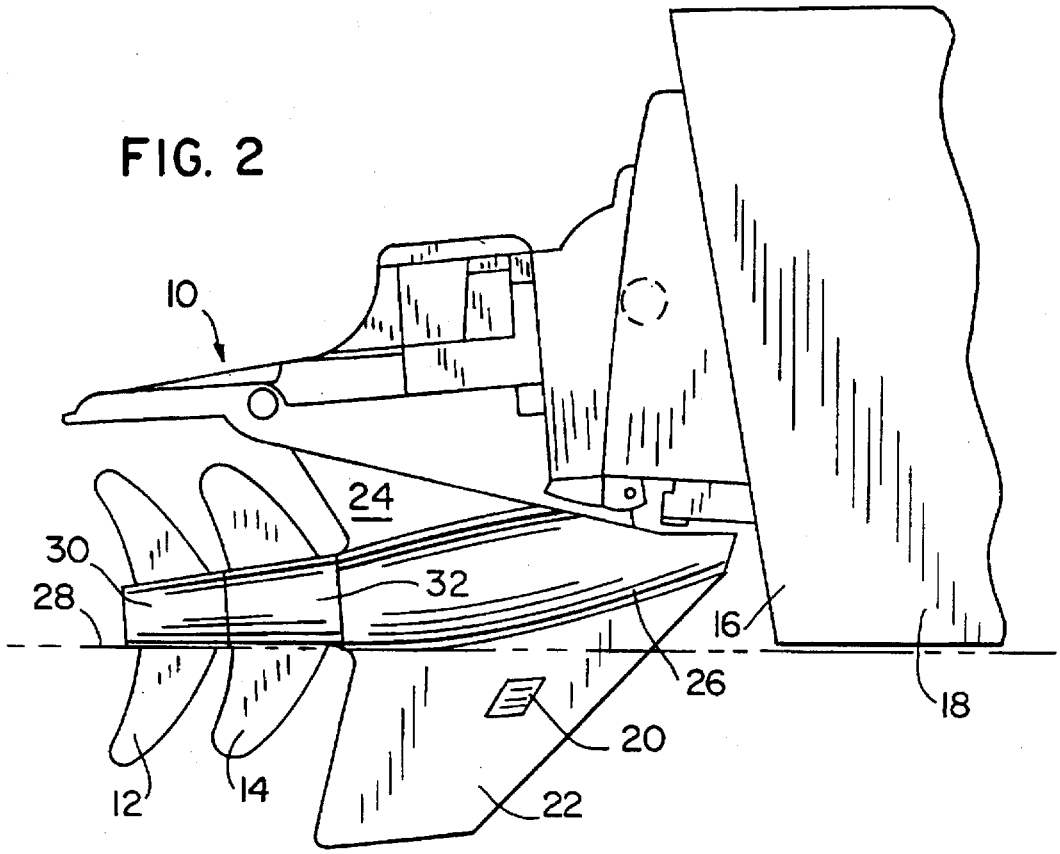
FIG. 2 is like FIG. 1 but shows a trimmed-in condition.
Figure 3:
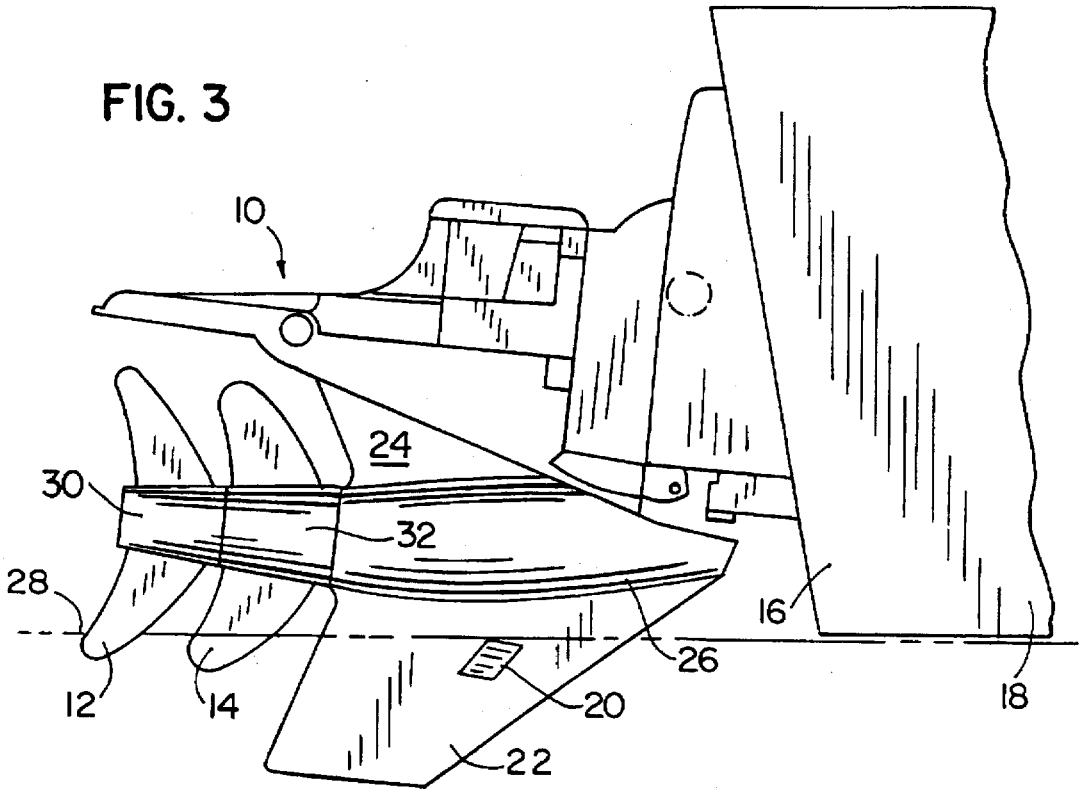
FIG. 3 is like FIG. 1 but shows a trimmed-out condition.

The invention is applicable in combination to surfacing drive 10, FIG. 1, having a trimmed-in condition, FIG. 2, lowering the bow of the boat, and a trimmed-out condition, FIG. 3, raising the bow. The invention is particularly helpful in a surfacing drive because of the latter's limited ability to increase running trim angle by trimming out the drive. The surfacing drive may have a single propeller or may have dual counter-rotating coaxial propellers. The invention is also applicable in combination to a submerged drive having a trimmed-in condition lowering the bow of the boat, and a trimmed-out condition raising the bow. The submerged drive may have a single propeller or may have dual counter-rotating coaxial propellers. In a submerged drive, the one or more propellers run entirely or mostly below the surface of the water. A submerged drive has greater ability than a surfacing drive to lift the bow and to increase running trim angle by trimming out the drive.

In the present invention, running trim angle is increased by reducing wetted planing surface area by removing wetted planing surface at areas of least dynamic pressure and by shifting a portion of the rearmost trailing edge of the wetted planing surface forwardly, in combination, until running trim angle is slightly less than porpoising trim angle. This is tested and confirmed by running the boat at top speed, and then trimming the drive and reducing boat speed and observing when the boat begins to porpoise. If the boat can be made to porpoise when it is running at 70% to 100% of top speed, then sufficient wetted planing area has been removed and the noted portion of the rearmost trailing edge of the wetted planing surface has been shifted sufficiently forwardly to provide the desired running trim angle. With a submerged drive, which has a greater ability to increase the running trim angle, if porpoising can be achieved at 80% to 100% of top speed, then sufficient wetted planing area has been removed and the noted portion of the rearmost trailing edge of the wetted planing surface has been shifted sufficiently forwardly to provide the desired running trim angle. The amount of wetted planing surface removed and the amount of forward shifting of the noted portion of the rearmost trailing edge of the wetted planing surface are empirically determined case-by-case according to the particular boat and the particular drive and the combination thereof. Due to the high number of variables involved and the complexities of the flow dynamics, empirical rather than mathematical design has been found best. The noted verification testing is simple and easy to perform, to confirm that the desired running trim angle has been achieved. In performing a test run, it is preferred that the boat be run with minimum weight therein, with the driver being the only person in the boat, and the fuel tank about half full, and that nothing else is added to the bare boat weight.

The present invention controls porpoising at boat speeds below top speed, yet operates near porpoising at top speed. As boat speed is reduced, the stern drops deeper in the water and the bow lifts, and hence running trim angle is increased. It is desirable to prevent such running trim angle from increasing beyond the porpoising trim angle. For maximum top speed in accordance with the invention, the boat can be made to porpoise or not porpoise on smooth water by trimming the drive. As boat speed is reduced below top speed it is important that the increase in running trim angle be controlled so as not to exceed the porpoising trim angle. In accordance with the invention, this is done is several ways. The uncut planing surface of the boat bottom on each side of the notch is only partially covered with solid water at top speed. As speed is reduced the aft end of the planing surface sinks deeper in the water, and the angle between the spray root lines increases to widen the strip of solid water on each side of the notch. This provides more lift at the aft end of the planing surface, to reduce the increase of trim angle that comes with a decrease in boat speed. Additionally, wedges such as 130 and 132 can be added to the aft end of the planing surface at least partly outside of the spray root lines at top speed. As boat speed is reduced and the angle between the spray root lines increases, the wedges have more solid water passing across them and produce more lift at the aft end of the planing surface, to reduce the increase in trim angle. Additionally, the spray root lines may pass across trim tabs such as 134 at top speed so that solid water is contacting only the inner part of the trim tab surface. As boat speed is reduced and the angle between the spray root lines increases, solid water contacts more and finally all of the trim tab surface, enabling the trim tabs to be increasingly effective in producing lift to control the increase in trim angle of the boat at lower speeds. Additionally, trimming the drive down or in causes the propellers to develop lift to control the increase in trim angle as the boat slows. Drives with surfacing propellers are effective in this manner, as are drives with submerged propellers, because the propellers go deeper in the water as they are angled down to produce lift. Furthermore, the noted depth of the notch enables central aft undersurface 110 to recontact solid water flow as the boat slows down, and hence provide additional stern lift, to in turn lower the bow of the boat and prevent running trim angle from increasing beyond porpoising trim angle. The depth of the notch is such that at planing speeds less than top speed water breaking off step 96 contacts raised undersurface 110 and provides lift to help prevent porpoising. This is a significant aspect of the invention because it is desirable that porpoising also be prevented at planing speeds less than top speed. In the present invention, water breaking off step 96 at top speed does not contact raised undersurface 110, however while the boat is getting up on plane water breaking off step 96 does contact undersurface 110 and provides lift to aid planing, and furthermore at planing speeds less than top speed water breaking off step 96 contacts undersurface 110 and provides lift to help prevent porpoising. The use of any one or all of the above noted methods to prevent porpoising as boat speed is reduced is in accordance with the invention.

It is recognized that various equivalents, alternatives and modifications are possible within the scope of the appended claims.

I claim:

1. In a Vee bottom planing boat having a hull extending from a bow rearwardly to an aft end and having a trimmable drive and running chines dry at maximum speed, said hull having a wetted planing surface at said maximum speed defined by spray root lines and the trailing edge of the planing surface, a method for reducing drag by increasing running trim angle by removing wetted planing surface at areas of least dynamic pressure and locating a portion of the trailing edge of the wetted planing surface forwardly from said aft end by forming a step in said planing surface of said hull forwardly of said aft end and defining a notch with a raised undersurface extending rearwardly from said a step to said aft end such that running trim angle is less than porpoising trim angle, and yet the boat can be made to porpoise by trimming the drive up and out, and:

water breaking off said step does not contact said raised undersurface at said maximum speed;

at planing speeds less than said maximum speed, water breaking off said step contacts said raised undersurface to help control trim angle to less than porpoising trim angle; and while the boat is getting up on plane, water breaking off said step contacts said raised undersurface and provides lift to aid planing.

2. The method according to claim 1 comprising rounding the forward end of said notch to provide a curved notch such that a tangent to the curve of the notch at any point therealong forms an angle relative to the boat keel which is greater than or equal to the angle formed by the spray root lines relative to the keel at top speed.

3. The method according to claim 1 wherein the distance between said spray root lines at top speed and the sides of said notch decreases fore-to-aft.

4. The method according to claim 1 wherein said spray root lines extend at a first angle relative to the boat keel at top speed, and comprising tapering said forwardly moved portion along a second angle relative to the keel which is greater than or equal to said first angle.

5. The method according to claim 1 wherein the boat porpoises by trimming the drive up and out when the boat is running at 80% to 100% of top speed.

6. The method according to claim 1 wherein said spray root lines are outside of said notch at top speed.

7. The method according to claim 6 wherein the trailing edge of said wetted planing surface has a forward portion at the forward end of said notch and rearward portions laterally outward of said notch, and wherein said spray root lines at top speed cross said rearward portions of said trailing edge but not said step nor the notch sides.

8. The method according to claim 7 wherein said spray root lines are outside of said notch at all planing speeds.

9. The method according to claim 1 wherein the trailing edge of said wetted planing surface has a forward portion at the forward end of said notch and rearward portions laterally outward of said notch, and comprising providing downwardly protruding wedges at said rearward portions of said trailing edge laterally outward of said notch.

10. The method according to claim 9 wherein said wedges are at least partially laterally outward of said spray root lines at top speed.

11. The method according to claim 1 wherein the trailing edge of said wetted planing surface has a forward portion at the forward end of said notch and rearward portions laterally outward of said notch, and comprising providing trim tabs proximate said rearward portions of said trailing edge and crossed by spray root lines at top speed.

12. The method according to claim 1 wherein said drive is a surfacing drive with at least one propeller running with at least 25% of propeller diameter above the plane of the boat bottom.

13. The method according to claim 1 wherein said drive is a submerged drive with at least one propeller running with less than 25% of propeller diameter above the plane of the boat bottom, and the boat porpoises by trimming the drive up and out when running at 80% to 100% of top speed.

* * * * *